US010928011B2

(12) United States Patent
Gielen et al.

(10) Patent No.: US 10,928,011 B2
(45) Date of Patent: Feb. 23, 2021

(54) SOLID-STATE LIGHTING LAMP

(71) Applicant: SIGNIFY HOLDING B.V., Eindhoven (NL)

(72) Inventors: Vincent Stefan David Gielen, Gastel (NL); Johannes Petrus Maria Ansems, Hulsel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/316,648

(22) PCT Filed: Jul. 3, 2017

(86) PCT No.: PCT/EP2017/066446
§ 371 (c)(1),
(2) Date: Jan. 10, 2019

(87) PCT Pub. No.: WO2018/010990
PCT Pub. Date: Jan. 18, 2018

(65) Prior Publication Data

US 2019/0154207 A1 May 23, 2019

(30) Foreign Application Priority Data

Jul. 14, 2016 (EP) ..... 16179504

(51) Int. Cl.

| | |
|---|---|
| ***F21K 9/232*** | (2016.01) |
| ***F21V 3/02*** | (2006.01) |
| ***F21V 23/00*** | (2015.01) |
| ***F21V 29/70*** | (2015.01) |
| ***F21V 3/06*** | (2018.01) |
| ***F21K 9/60*** | (2016.01) |
| *F21Y 115/10* | (2016.01) |

(Continued)

(52) U.S. Cl.
CPC ..... *F21K 9/232* (2016.08); *F21K 9/60* (2016.08); *F21V 3/02* (2013.01); *F21V 3/061* (2018.02); *F21V 23/006* (2013.01); *F21V 29/70* (2015.01); *F21K 9/90* (2013.01); *F21V 23/009* (2013.01); *F21Y 2113/13* (2016.08); *F21Y 2115/10* (2016.08)

(58) Field of Classification Search
None
See application file for complete search history.

(56) References Cited

U.S. PATENT DOCUMENTS 7,588,351 B2 * 9/2009 Meyer ..... F21K 9/232 362/294
2011/0176316 A1 * 7/2011 Phipps ..... F21V 29/004 362/373

(Continued)

FOREIGN PATENT DOCUMENTS

CN 102460005 A 5/2012
CN 202791794 U 3/2013

(Continued)

*Primary Examiner* — Elmito Breval
(74) *Attorney, Agent, or Firm* — Daniel J. Piotrowski

(57) ABSTRACT

A solid-state lighting lamp (10) is disclosed. The solid-state lighting lamp (10) comprises a glass tube (14), an internal member at least partly arranged inside the glass tube (14), and optical means (50) arranged on the glass tube (14), completely covering an inner surface of the glass tube (14) and adapted to at least partly cloak the internal member.

14 Claims, 3 Drawing Sheets

(51) Int. Cl.
*F21Y 113/13* (2016.01)
*F21K 9/90* (2016.01)

(56) References Cited

U.S. PATENT DOCUMENTS

2011/0193473 A1* 8/2011 Sanders ..... F21K 9/232 313/483
2012/0262066 A1* 10/2012 Bakk ..... F21V 29/004 315/113
2013/0099667 A1 4/2013 Ye et al.
2013/0107523 A1 5/2013 Takeda
2013/0119866 A1* 5/2013 Matsuda ..... F21V 29/004 315/112
2013/0170175 A1* 7/2013 Negley ..... F21V 29/004 362/84
2015/0098230 A1* 4/2015 Tamura ..... F21V 19/005 362/382
2015/0176785 A1 6/2015 Liu
2016/0186978 A1* 6/2016 He ..... F21K 9/232 313/35
2016/0377278 A1* 12/2016 Kato ..... F21V 29/70 362/363
2018/0031218 A1* 2/2018 Knapp ..... F21K 9/238

FOREIGN PATENT DOCUMENTS

CN 203273327 U 11/2013
CN 103982872 A 8/2014
CN 203893037 U 10/2014
CN 105508893 A 4/2016
DE 102012220264 A1 5/2014
JP 2014102973 A 6/2014
WO 2015177038 A1 11/2015
WO WO-2015177038 A1 * 11/2015 ..... F21K 9/232
WO 2016012467 A1 1/2016

* cited by examiner

SOLID-STATE LIGHTING LAMP

CROSS-REFERENCE TO PRIOR APPLICATIONS

This application is the U.S. National Phase application under 35 U.S.C. § 371 of International Application No. PCT/EP2017/066446, filed on Jul. 3, 2017 which claims the benefit of European Patent Application No. 16179504.2, filed on Jul. 14, 2016. These applications are hereby incorporated by reference herein.

FIELD OF THE INVENTION

The present invention relates to a lamp based on SSL (solid-state lighting) technology.

BACKGROUND OF THE INVENTION

Visual aesthetics influence consumers' buying decisions for a wide range of products, including lamps. Lamps based on SSL technology typically have components that are difficult to integrate into the overall design of the lamp in an aesthetically pleasing way. For example, the lamp disclosed in CN 103982872 A has a conspicuous insertion portion which sticks into the glass bulb and which reduces the visual appeal of the lamp.

Meeting consumers' visual design preferences without compromising performance and cost is associated with many technical challenges. There is a need for further efforts aimed at addressing those challenges. In particular, there is a need to find ways to make visually unattractive lamp components less conspicuous.

In WO2015/177038 a solid state lighting device is disclosed with an inner envelope and an outer envelope. The solid state light sources are positioned in the inner envelope. The space in between the inner and outer envelope forms a cavity that acts as a heat pipe for transporting the heat generated by the solid state light sources from the inner envelope to the outer envelope from which it is transmitted to the ambient.

WO 2016/012467 discloses a solid state lighting device with light transmissive heat pipe configured to dissipate thermal energy from the light source. The heat pipe comprises a flexible conduit configured as wick.

US 2013/107523 discloses a light source device that uses a laser diode. The device is provided with an outer envelope (globe-type) and an inner tube like structure with a fluorescent material for converting the laser light into visible light, therewith realizing a light source device with a light emitting inner tube.

SUMMARY OF THE INVENTION

It would be advantageous to provide an SSL lamp that represents an attractive trade-off between technical performance, costs and aesthetics. To better address this concern, and according to a first aspect, there is presented an SSL lamp which comprises a glass tube, an internal member at least partly arranged inside the glass tube, and optical means arranged on the glass tube and adapted to at least partly cloak the internal member.

The optical means are adapted to alter the visibility of the internal member, for example by making it appear thinner, longer or flatter. The optical means may be adapted to render the internal member nearly invisible to an observer. The internal member will therefore not disturb, or at least to a lesser extent disturb, the visual aesthetics of the SSL lamp, whereby the visual appearance of the SSL lamp is improved. Further, the fact the optical means make the internal structure less of a concern from a visual design perspective implies more freedom of choice for the manufacturer of the SSL lamp. For instance, consider the example case where the internal member is a heat spreader. It may then be possible to give the heat spreader a shape that optimizes technical performance or production costs, even though that shape is not visually appealing, and/or to make the heat spreader of a material that represents the best choice from a technical or an economic perspective, even though that material is a poor choice from a visual design perspective.

The optical means may be adapted to redirect light striking the optical means so as to alter the visibility of the internal member. An efficient "cloaking effect" can be achieved by optical means that operate by redirecting light. It should be noted that most of the light striking the optical means is light coming from the surroundings (and not light coming directly from the SSL lamp).

The optical means may be arranged between the internal member and the glass tube. It is possible to achieve a strong "cloaking effect" by arranging the optical means in this way.

The optical means may completely cover an inner surface of the glass tube. The inner surface of the glass tube faces the internal member. The optical means may in some situations not cover the entire inner surface, for example if the internal member is smaller than the glass tube.

The optical means may be an optical foil. By an "optical foil" is meant a thin foil, film, sheet, or the like, which is adapted to affect light incident thereon in some way, for example by being provided with an interior structure affecting how light travels inside the foil and/or surface elements, such as micro prisms or the like, affecting light how light is reflected and/or refracted at the surface of the foil. Optical foils can provide a strong "cloaking effect." Further, the thinness of the optical foil facilitates its integration into existing types of SSL lamps. The manufacturing process does not become more complicated, and the other components do not need to be modified, or at least only marginally so. Further, the optical foil can be inexpensive to manufacture, so it typically represents a very small part of the total cost of the SSL lamp.

The optical means may be a prismatic foil. Prismatic foils typically operate by total internal reflection and are capable of capturing, guiding and releasing light in such a way that they seem to bend light. Prismatic foils are particularly suitable for some applications.

The optical means may be a brightness enhancement foil. Brightness enhancement foils are capable of redirecting light by reflection and refraction, and they are particularly suitable for some applications. For example, such foils can be used to render the internal member almost invisible to an observer looking at the SSL lamp from a specific direction.

The optical means may be a plastic optical foil. Plastic optical foils typically offer a high level of technical performance while being relatively inexpensive to manufacture.

The optical means may be a surface structure on the glass tube. The surface structure may be arranged or formed on the inner surface of the glass tube, i.e. on the surface of the glass tube that faces the internal member, and/or on the outer surface of the glass tube. The surface structure may be adapted to for example reflect and/or refract incident light. The surface structure may for example a prismatic surface structure. The surface structure may for example comprise facets and/or micro prisms.

The internal member may comprise a cylindrical heat spreader and an SSL unit adapted to emit light, wherein the SSL unit is in thermal contact with the heat spreader. A heat spreader is an example a component that one typically wants to be as inconspicuous as possible, and the optical means are therefore particularly advantageous in situations where the internal member comprises a heat spreader. The optical means may be arranged so as to cover only the heat spreader, and not the SSL unit, so that light emitted by the SSL unit does not strike the optical means. However, the optical means may in some embodiments be arranged, and adapted, so as to, for example, reflect and/or diffuse the light emitted by the SSL unit. In such case, the optical means may completely or partly cover the SSL unit.

The internal member may further comprise a driver arranged at least partly inside the cylindrical heat spreader and electrically connected to the SSL unit. Arranging the driver that powers the SSL unit inside the heat spreader helps to make the SSL lamp compact.

The cylindrical heat spreader may have a first section, arranged inside the glass tube, and a second section extending outside the glass tube. An end cap of the SSL lamp may be attached to the second section of the cylindrical heat spreader. It is possible to attach the heat spreader to the end cap by pressing it into the end cap, something which is simple from a manufacturing perspective and also means that it is not necessary to provide the SSL lamp with an interface part connecting the glass bulb to the end cap. Prior art SSL lamps typically have such an interface part, and this makes them look quite different from traditional incandescent lamps. The SSL lamp of the present invention may therefore be particularly suitable for applications where consumers prefer a lamp that resembles a traditional incandescent lamp.

The end cap may be connectable to an Edison screw socket. Such an end cap can make the SSL lamp especially suitable for retrofitting applications.

The SSL lamp may further comprise a glass bulb, the glass tube being arranged inside the glass bulb and joined with the glass bulb. Such an SSL lamp can be produced on standard GLS (general lighting service) productions lines, something which is advantageous from a manufacturing perspective because such production lines are highly optimized with respect to speed and efficiency.

The glass tube may extend beyond a top of the first section of the cylindrical heat spreader as seen along a longitudinal axis of the SSL lamp in a direction away from the end cap. The glass tube may be longer than the first section of the cylindrical heat spreader as measured along a longitudinal axis of the SSL lamp. With such a glass tube it is, for example, not necessary to provide the SSL lamp with a glass bulb, and such SSL lamps can be particularly compact and robust. They are also easy to manufacture using simple machines and tools.

It is noted that the invention relates to all possible combinations of features recited in the claims.

BRIEF DESCRIPTION OF THE DRAWINGS

These and other aspects of the present invention will now be described in more detail, with reference to the appended drawings showing embodiment(s) of the invention.

As illustrated in the figures, the sizes of layers and regions may be exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
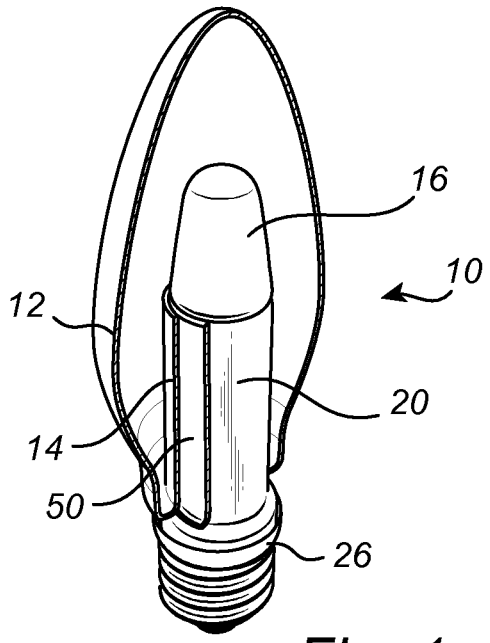
FIG. 1 is a partly cross-sectional perspective view of an SSL lamp according to an embodiment of the present invention.
Figure 2:
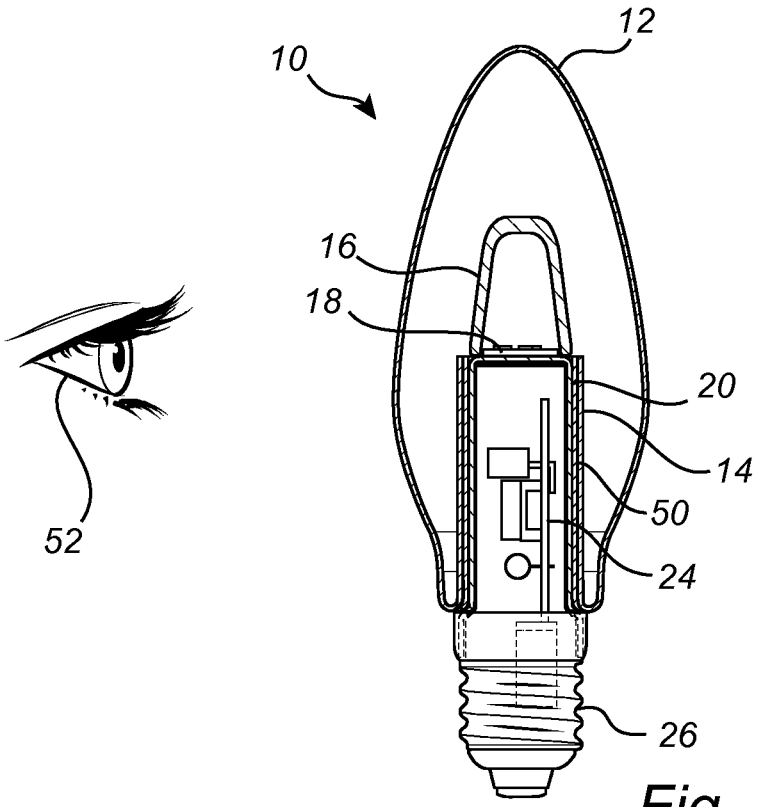
FIG. 2 is a partly cross-sectional side view of the SSL lamp of FIG. 1.
Figure 3:
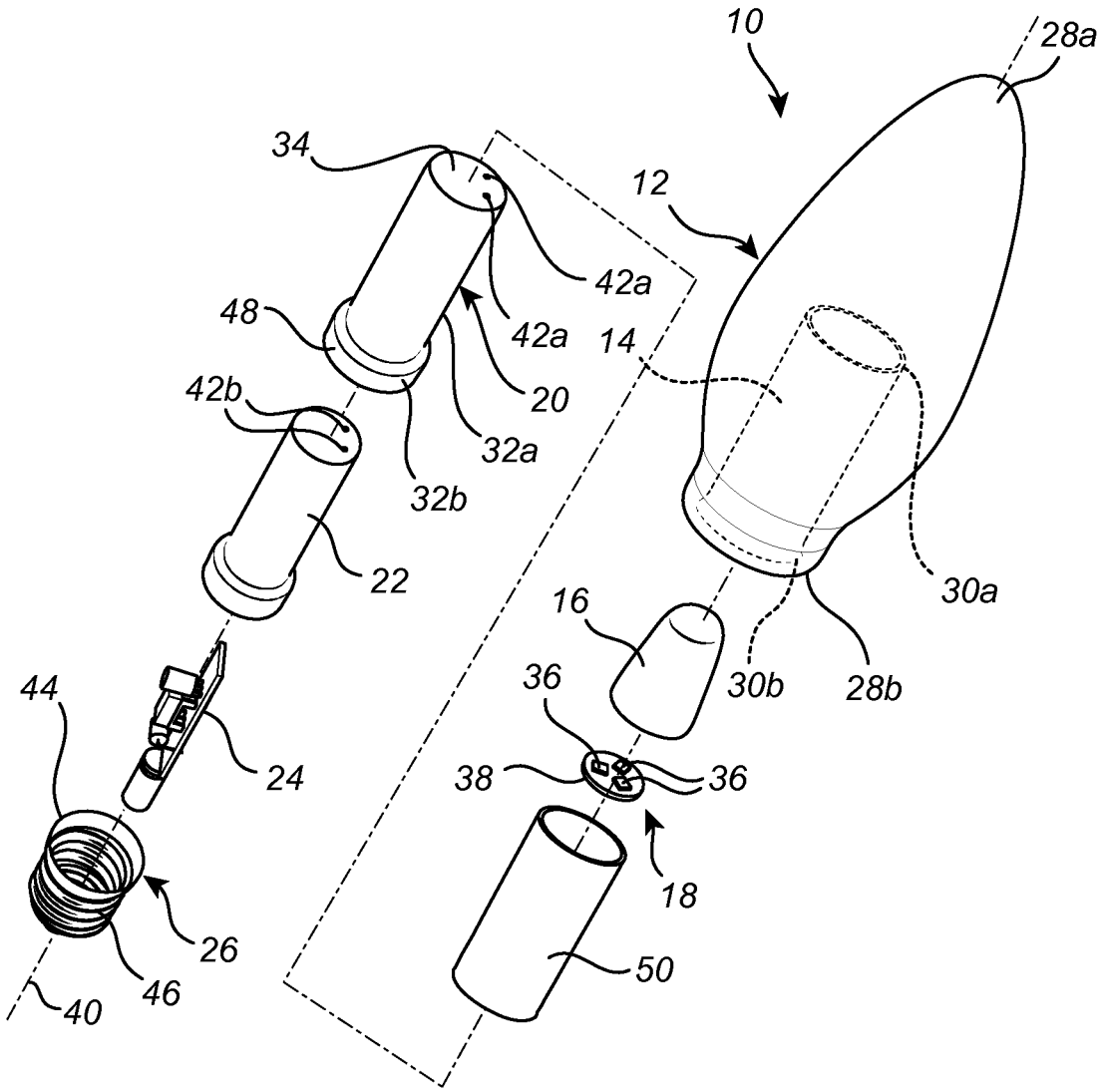
FIG. 3 is an exploded perspective view of the SSL lamp of FIG. 1.

FIGS. 1 to 3 illustrate an SSL lamp 10 according to an embodiment of the present invention. The SSL lamp 10 in FIGS. 1 to 3 is an LED (light-emitting diode) candle lamp. The SSL lamp 10 may be a retrofit lamp.

From top to bottom as seen in FIG. 3, the SSL lamp 10 comprises a glass bulb 12 with a glass tube 14, an optical part 16, an SSL unit 18, a heat spreader 20, a driver insulator 22, a driver 24, and an end cap 26. The SSL unit 18 and the heat spreader 20 may together be referred to as an internal member of the SSL lamp 10.

The glass bulb 12 is candle-shaped ("B-shape"). The glass bulb 12 could be clear or frosted. The glass bulb 12 can be made by blowing glass in a mold. The wall of the glass bulb 12 is thin and (substantially) uniform. The wall thickness of the glass bulb 12 may for example be in the range of 0.35 mm to 1.00 mm. The glass bulb 12 has a distal top (or tip) 28*a* and a proximal base 28*b* relative to the end cap 26. This means that the base 28*b* is closer to the end cap 26 than the top 28*a*.

The glass tube 14 may be a standard size extruded glass tube. The glass tube 14 has an open distal end 30*a* and a proximal end 30*b* relative to the end cap 26. Like above, this means that the end 30*b* is closer to the end cap 26 than the end 30*a*. The glass tube 14 is clear, transparent or at least partly transparent.

The proximal end 30*b* of the glass tube 14 is joined with the proximal base 28*b* of the glass bulb 12. The glass tube 14 and the glass bulb 12 may for example be melted together at the proximal end 30*b*/proximal base 28*b*, like in incandescent bulbs, but without any pump tube or stem wires. Hence, the glass tube 14 is freestanding, i.e. it is standing alone inside the glass bulb 12 without being attached to the glass bulb 12 except at said proximal end 30*b*.

The heat spreader 20 is cylindrical. The heat spreader 20 can for example be deep drawn from highly thermally conductive sheet metal, such as aluminum. Alternatively the heat spreader 20 could be cold forged, for example. The heat spreader 20 comprises a first section 32*a* and a second section 32*b*. The top of the first section of 32*a* is closed, forming a top surface 34. The second section 32*b* may have a larger outer diameter than the first section 32*a*. The first section 32*a* of the heat spreader 20 may substantially match the interior of the glass tube 14, and is arranged inside the glass tube 14. The top surface 34 of the first section 32*a* of the heat spreader 20 may be in level with the distal end 30*a* of the glass tube 14, as can be seen in FIG. 2. To this end, the glass tube 14 and the first section 32*a* of the heat spreader 20 may have the same or substantially the same length. The second section 32*b* of the heat spreader 20, on the other hand, extends outside (or below) the glass tube 14 and glass bulb 12, as also seen in FIG. 2.

The SSL unit 18 is generally adapted to emit light. The SSL unit 18 is mounted on top of the first section 32*a* of the heat spreader 20, i.e. on the top surface 34. The SSL unit 18 can be mounted to the heat spreader 20 by use of thermally conductive (non-electrical insulative) paste, for optimal thermal performance. The SSL unit 18 may comprise one or more SSL elements 36 acting as light sources. The SSL elements 36 may for example be LEDs. The SSL unit 18 may also comprise a printed circuit board 38, such as an MCPCB (metal-core printed circuit board), on which the one or more SSL elements 36 are mounted. In the illustrated embodiment, the SSL unit 18 is horizontally arranged, i.e. the PCB 38 is transversal to the longitudinal axis 40 of the SSL lamp 10. The light distribution generated by the SSL lamp 10 may be symmetric with respect to the longitudinal axis 40.

The optical part 16 is provided over the SSL unit 18. The optical part 16 in the illustrated embodiment is a TIR (total internal reflection) optic. The TIR optic may be shaped like a cone with a blunt tip. The TIR optic could be injection molded. The TIR optic serves to distribute light emitted by the SSL elements 36 towards the side and also downwards, towards the end cap 26, which is beneficial for a candle lamp. The TIR optic could be replaced by a diffuser or a toroid reflector, for example.

In an alternative embodiment (not shown), the SSL unit 18 could be vertically arranged, to create a more omnidirectional distribution and not requiring an optic to bring the light downwards, although a diffuser may be beneficial to reduce glare or spottiness.

The driver 24 is generally adapted to regulate the power to the SSL unit 18. The driver 24 may also contain electronics necessary for dimming, connectivity, etc. The driver 24 is provided at least partly inside the heat spreader 20. The driver insulator 22 may be provided between the heat spreader 20 and the driver 24. The driver insulator 22 may be shaped like a cylinder, with a closed top. The driver insulator 22 may for example be an inner dielectric coating on the heat spreader 20, or a separate electrical insulator. The driver insulator 22 can be thermoformed. The driver 24 is electrically connected to the SSL unit 18. To this end, holes 42*a*, 42*b* may be provided in the top of the heat spreader 20 and the driver insulator 22, respectively, through which holes 42*a*, 42*b* electrical conductors between the driver 24 and SSL unit 18 may pass.

The end cap 26 is generally adapted to mechanically and electrically connect the SSL lamp 10 to an external socket (not shown). The end cap 26 may have a mantel 44 and an external threading 46. The end cap can be of the type E14. The end cap 26 may for example be an aluminum end cap. The end cap 26 is attached to the circumferential outer surface 48 of the second section 32*b* of the heat spreader 20. The cylindrical heat spreader 20 may have a direct thermal connection to the end cap 26. This enables heat sinking through the end cap 26 through conduction, rather than just heat dissipation through convection at the outer surface of the bulb 12/glass tube 14. It is also a cost efficient way to make a strong stable connection between heat spreader 20 and end cap 26 without any intermediate part(s). The second section 32*b* of the heat spreader 20 may for example be pressed into the mantle 44 of the end cap 26. Hence, the end cap 26 may be press fitted to the heat spreader 20. The end cap 26 may about the proximal end of the joint glass bulb 12 and glass tube 14, i.e. at 28*b*/30*b*. In this way, the transition between the end cap 26 and the glass bulb 12 may be smooth.

An optical means in the form of an optical foil 50 is arranged on the glass tube 14, more precisely between the cylindrical heat spreader 20 and the glass tube 14. Differently stated, the optical foil 50 is sandwiched between the glass tube 14 and the cylindrical heat spreader 20. The optical foil 50 is in contact with an inner surface of the glass tube 14 and with an outer surface of the cylindrical heat spreader 20. The optical foil 50 is cylindrical. The optical foil 50 may for example have been formed by bending a rectangular piece of optical foil cut from a large sheet and then attaching the edges together. The glass tube 14, the optical foil 50 and the cylindrical heat spreader 20 are concentrically arranged around the longitudinal axis 40. The optical foil 50 extends from the interface between the first and second sections 32*a*, 32*b* to the top of the first section 32*a*, i.e. to the level of the top surface 34. The optical foil 50 thus covers substantially the entire inner surface of the glass tube 14. The optical foil 50 can for example be made of PC, PMMA, PET, COP, COC, PS, PEI or silicone. The thickness of the optical foil 50 is typically in the range from about 0.1 mm to about 0.5 mm. The optical foil 50 may alternatively be referred to as an optical film. The optical foil 50 may for example be a prismatic foil or a brightness enhancement foil. There are many different types of such optical foils commercially available. For instance, 3M sells brightness enhancement foils under the trade name Vikuiti.

In use, the SSL lamp 10 is fitted in an external socket, and power is supplied from the external socket via the end cap 26 and the driver 24 to the SSL unit 18, so that light is emitted. Heat generated when the SSL lamp 10 is on may be dissipated partly through conduction to the end cap 26 (max 5%), partly through radiation (less than 40%), and the rest through convection by the ambient air. Further, in use, the heat spreader 20 is cloaked by the optical foil 50 as seen from outside of the SSL lamp 10 by an observer 52. The optical foil 50 redirects incident light in such a way that the visibility of the heat sink 20 for the outside observer 52 is reduced. For example, a brightness enhancement foil may be adapted to redirect light striking the foil perpendicularly so that the light goes back in the approximately same direction from which it came. So a brightness enhancement film can be used as a kind of reflector that redirects light in such a way that the observer 52 cannot see, or at least almost cannot see, the heat sink 20 from the perpendicular view.

Figure 4:
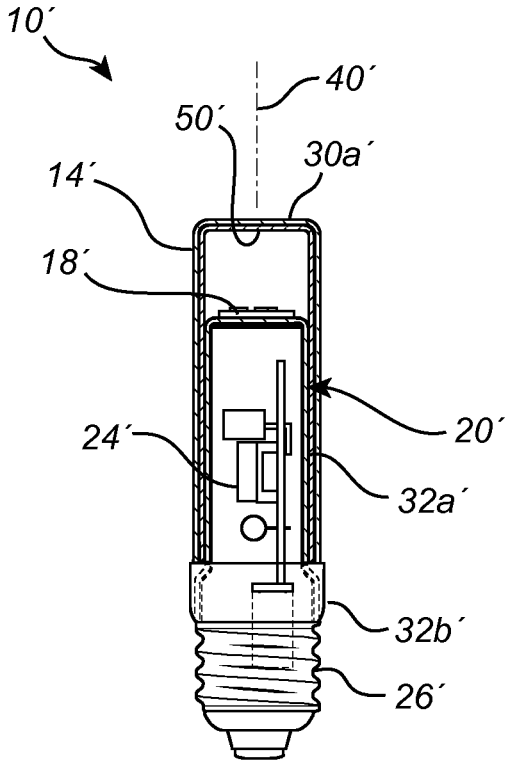
FIG. 4 is a partly cross-sectional side view of an SSL lamp according to another embodiment of the present invention.

FIG. 4 discloses another SSL lamp 10' which is similar to the SSL lamp 10 described above in connection with FIGS. 1 to 3, but without the glass bulb 12. The SSL lamp 10' comprises: a glass tube 14'; a cylindrical heat spreader 20' having a first section 32*a*' arranged inside the glass tube 14' and a second section 32*b*' extending outside the glass tube 14'; an SSL unit 18' mounted on top of the first section 32*a*' of the cylindrical heat spreader 20'; a driver 24' provided at least partly inside the cylindrical heat spreader and electrically connected to the SSL unit 18'; and an end cap 26' attached to the second section 32*b*' of the cylindrical heat spreader 20'. The first section 32*a*' of the cylindrical heat spreader 20' is shorter than the glass tube 14' as measured along the longitudinal axis 40' of the SSL lamp 10'. The glass tube 14' extends beyond the top of the first section 32*a*' of the cylindrical heat spreader 20' in the direction away from the end cap 26' towards the cylindrical heat spreader 20' and along the longitudinal axis 40'. There is thus a longitudinal gap between the top of the cylindrical heat spreader 20' and the distal end 30*a*' of the glass tube 14'. The heat spreader 20' is typically less than 15 mm shorter than the glass tube 14'. The distal end 30*a*' of the glass tube 14' is closed.

An optical means in the form of an optical foil 50' is arranged between the cylindrical heat spreader 20' and the glass tube 14', similarly to how the optical foil 50 in FIGS. 1 to 3 is arranged. The inner side of the closed distal end 30*a*' of the glass tube 14' is covered by the optical foil 50', so light emitted by the SSL unit 18' strikes the optical foil 50'. The optical foil 50' may be adapted to affect the light emitted by the SSL unit 18' similarly to how the optical part 16, described above in connection with FIGS. 1 to 3, affects light. For example, the optical foil 50' may be adapted to diffuse the light emitted by the SSL unit 18'. In those applications where the SSL unit 18' comprises LEDs of different colors, the optical foil 50' may be adapted to mix light having different colors.

In an alternative embodiment (not shown), it may be that the optical foil 50' does not extend all the way up to the distal end 30*a*' of the glass tube 14'. The optical foil 50' would then typically cover the entire first section 32*a*' of the cylindrical heat spreader 20'.

The person skilled in the art realizes that the present invention by no means is limited to the preferred embodiments described above. On the contrary, many modifications and variations are possible within the scope of the appended claims. For example, the glass bulb can have a different shape than the shape illustrated in FIGS. 1 to 3, such as the shape of a P45 bulb.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A solid-state lighting lamp, comprising:
- a glass tube, the glass tube being open at both ends,
- a glass bulb, the glass tube being arranged inside the glass bulb and directly attached to the glass bulb,
- an internal member at least partly arranged inside the glass tube, and
- optical means arranged on the glass tube, completely covering an inner surface of the glass tube and adapted to at least partly cloak the internal member; and
- wherein the optical means are adapted to redirect light striking the optical means so as to alter the visibility of the internal member.

2. The solid-state lighting lamp according to claim 1, wherein the optical means is a surface structure on the glass tube.

3. The solid-state lighting lamp according to claim 1, wherein an end of the glass tube and an end of the glass bulb are melted together.

4. A solid-state lighting lamp, comprising:
- a glass tube, the glass tube being open at both ends,
- a glass bulb, the glass tube being arranged inside the glass bulb and directly attached to the glass bulb,
- an internal member at least partly arranged inside the glass tube, and
- optical means arranged on the glass tube, completely covering an inner surface of the glass tube and adapted to at least partly cloak the internal member; and
- wherein the optical means is an optical foil.

5. The solid-state lighting lamp according to claim 4, wherein the optical means is a prismatic foil.

6. The solid-state lighting lamp according to claim 4, wherein the optical means is a brightness enhancement foil.

7. The solid-state lighting lamp according to claim 4, wherein the optical means is a plastic optical foil.

8. A solid-state lighting lamp, comprising:
- a glass tube,
- a glass bulb, the glass tube being arranged inside the glass bulb and directly attached to the glass bulb,
- an internal member at least partly arranged inside the glass tube, and
- optical means arranged on the glass tube, completely covering an inner surface of the glass tube and adapted to at least partly cloak the internal member;
- wherein the internal member comprises:
- a cylindrical heat spreader having a first section, wherein the first section is arranged inside the glass tube and has substantially the same length as the glass tube; and
- a solid-state lighting unit adapted to emit light, wherein the solid-state unit is in thermal contact with the heat spreader.

9. The solid-state lighting lamp according to claim 8, wherein the internal member further comprises a driver arranged at least partly inside the cylindrical heat spreader and electrically connected to the solid-state lighting unit.

10. The solid-state lighting lamp according to claim 8, wherein the cylindrical heat spreader has a second section extending outside the glass tube, and wherein an end cap of the solid-state lighting lamp is attached to the second section of the cylindrical heat spreader.

11. The solid-state lighting lamp according to claim 10, wherein the end cap is connectable to an Edison screw socket.

12. The solid-state lighting lamp according to claim 10, wherein the glass tube extends beyond a top of the first section of the cylindrical heat spreader as seen along a longitudinal axis of the solid-state lighting lamp in a direction away from the end cap.

13. A solid-state lighting lamp, comprising:
- a glass tube, the glass tube being open at both ends, and comprising a glass surface structure;
- a glass bulb, the glass tube being arranged inside the glass bulb and joined with the glass bulb;
- an internal member at least partly arranged inside the glass tube; and,
- an optical means formed on the glass tube, completely covering an inner surface of the glass tube; wherein the optical means comprises the glass surface structure, and is adapted to at least partly cloak the internal member.

14. The solid-state lighting lamp according to claim 13, wherein the glass surface structure comprises prismatic elements selected from the group consisting of facets, micro prisms, and combinations thereof.

* * * * *